US007737362B2

(12) United States Patent
Ogura

(10) Patent No.: US 7,737,362 B2
(45) Date of Patent: Jun. 15, 2010

(54) MULTI-LAYER SHIELDED WIRE

(75) Inventor: Hiroyuki Ogura, Susono (JP)

(73) Assignee: Yazaki Corporation, Tokyo (JP)

( * ) Notice: Subject to any disclaimer, the term of this patent is extended or adjusted under 35 U.S.C. 154(b) by 42 days.

(21) Appl. No.: 12/133,434

(22) Filed: Jun. 5, 2008

(65) Prior Publication Data

US 2008/0314636 A1 Dec. 25, 2008

(30) Foreign Application Priority Data

Jun. 19, 2007 (JP) ..... 2007-161340

(51) Int. Cl.
*H01B 7/10* (2006.01)

(52) U.S. Cl. ..... 174/102 R

(58) Field of Classification Search ..... 174/102 R, 174/102 SC, 106 R, 106 SC, 110 R, 113 R, 174/113 SC See application file for complete search history.

(56) References Cited

U.S. PATENT DOCUMENTS 3,339,007 A * 8/1967 Blodgett ..... 174/25 R
RE30,228 E * 3/1980 Silver et al. ..... 174/36

FOREIGN PATENT DOCUMENTS

JP 2003-229028 A 8/2003
JP 2006-173044 A 6/2006

* cited by examiner

*Primary Examiner*—William H Mayo, III
(74) *Attorney, Agent, or Firm*—Sughrue Mion, PLLC

(57) ABSTRACT

A multilayer shielded wire includes an inner conductor, a first conductor which covers the inner conductor through a first insulating layer, and a second conductor which covers the first conductor through a second insulating layer. A predetermined interlayer distance between the first conductor and the second conductor are set. A conductive portion is provided between the first conductor and the second conductor to electrically connect the first conductor to the second conductor.

9 Claims, 8 Drawing Sheets

Prior Art

Prior Art

MULTI-LAYER SHIELDED WIRE

BACKGROUND

The present invention relates to a multi-layer shielded wire with excellent electromagnetic shield capability, which is mainly used in a vehicle.

In a vehicle, a shielded wire having an electromagnetic shield layer composed of a metal conductor is used as a transmission line of a radio frequency (RF) signal, an image signal or a communication signal received by an antenna.

The shield wire is formed by covering an inner conductor (one core or multicore) with an insulating layer, covering the insulating layer with an outer conductor, and providing a protective layer such as vinyl chloride (PVC) on an outermost layer as a protective material.

The outer conductor is mainly composed of a metal foil or a braided wire. The metal foil which is formed by attaching several μm of aluminum or copper on the surface a thin plastic film such as polyethylene and has a film shape is generally used. The braided wire which is formed by braiding a plurality of copper thin lines (wires) is generally used.

The metal foil and the braided wire are different from each other in the frequency characteristics of the shield capability. If the outer conductor is composed of one layer, although changed according to the condition, if the braided wire is used in a frequency band of 100 MHz or less and the metal foil is used in a frequency band of more than 100 MHz, the capability is high. The metal foil and the braided wire are properly selected according to the use purpose of the electric wire from the viewpoint of terminal machining or mechanical strength as well as shield capability.

From the same reason, if the use purpose is not achieved by one layer, the metal foil or the braided wire may overlap by two layers or more or a combination of the metal foil and the braided wire may be used. In particular, in a high frequency band of 100 MHz or more, since it is difficult to obtain the shield effect by one layer compared with a frequency band of less than 100 MHZ, a multilayer structure is generally used.

If the outer conductor is composed of two layers or more, there is a case of inserting an insulating layer between the layers and a case of electrically contacting electromagnetic conductors without inserting an insulating layer. The former case may be called two layers and the latter case may be called two folds. Even in the two layers, the terminal may be short-circuited when the electric wire terminal is machined.

This type of related multilayer shielded wire is, for example, disclosed in Patent Document 1 or Patent Document 2.

FIGS. 8A and 8B show a related configuration example of a two-layer shielded wire. The two-layer shielded wire 100 is formed by covering an outer circumference of an one-core inner conductor 111 with a first insulating layer (dielectric) 112, sequentially covering the first insulating layer with a first outer conductor (electromagnetic shield layer) 113, a second insulating layer (dielectric layer) 114 and a second outer conductor (electromagnetic shield layer) 115, and providing a protective layer 116 on an outermost layer.

A shielded wire 120 shown in FIG. 9 is formed by directly contacting outer conductors 113 and 115 without inserting an insulating layer between the first outer conductor 113 and the second outer conductor 115.

[Patent Document 1] JP-A-2006-173044

[Patent Document 2] JP-A-2003-229028

In the related multilayer shielded wire, if shield capability is desired to be increased, manufacturing cost is increased, a weight is increased or the diameter of the electric wire is increased as the number of layers is increased.

SUMMARY

The present invention is contrived to solve the above-mentioned problems. An object of the present invention is to provide a multilayer shielded wire with a small diameter, light weight, low cost and excellent electromagnetic shield capability.

The object of the present invention is achieved by the configurations (1) to (6).

(1) A multilayer shielded wire, comprising:

an inner conductor;

a first conductor which covers the inner conductor through a first insulating layer; and a second conductor which covers the first conductor through a second insulating layer;

wherein a predetermined interlayer distance between the first conductor and the second conductor are set; and wherein a conductive portion is provided between the first conductor and the second conductor to electrically connect the first conductor to the second conductor at a plurality of points.

(2) Preferably, the conductive portion is formed by granular or rod-shaped conductors which are contained in a resin material configuring the second insulating layer.

(3) Preferably, the conductive portion is formed by granular or rod-shaped conductors which are filled in through-holes in a resin film configuring the second insulating layer.

(4) Preferably, the conductive portion includes a plurality of protrusions which are formed on a surface of at least one of the first and second conductors. The protrusions are brought into contact with a surface of the other of the first and second conductors so that the first and second conductors are electrically connected to each other at a plurality of points.

(5) Preferably, at least one of the first and second conductors has a wave shape in which concavities and convexities are alternately arranged.

Tops of the convexities are brought into contact with a surface of the other of the first and second conductors so that the first and second conductors are electrically connected to each other at a plurality of points.

(6) Preferably, the conductive portion includes a braided wire having concavities and convexities in a surface thereof or a plurality of thin lines.

According to the multilayer shielded wire of (1), since the first conductor and the second conductor are electrically connected to each other at the plurality of points, significant electromagnetic shield effect can be obtained compared with the related art, even in the same number of shield layers and the same interlayer distance. In the same electromagnetic shield capability as the related art, the number of layers and the thickness of the layer can be reduced, the metal material used in the shield layer can be reduced, the diameter of the electric wire can be reduced, and lightweight and low cost can be realized.

According to the multilayer shielded wire of (2), since the first and second conductors are electrically connected to each other at the plurality of points by the granular or rod-shaped conductor contained in the resin material configuring the insulating layer, the shield effect can be adjusted by adjusting the thickness of the resin material configuring the insulating layer or the amount or the shape of the conductors contained in the resin material.

According to the multilayer shielded wire of (3), since the first and second conductors are electrically connected to each other at the plurality of points by the granular or rod-shaped conductor filled in the through-holes of the resin film configuring the insulating layer provided between the first and second conductors, the shield effect can be adjusted by adjusting the thickness of the resin film or the number of through-holes.

According to the multilayer shielded wire of (4), since the first and second conductors are electrically connected to each other at the plurality of points by forming the plurality of protrusions on at least one of the first and second conductors and bringing the protrusions into contact with the surface of the other conductor, the shield effect can be adjusted by adjusting the number or the size of protrusions.

According to the multilayer shielded wire of (5), since the first and second conductors are electrically connected to each other at the plurality of points by forming the irregularities on at least one of the first and second conductors and bringing the tops of the convex portions into contact with the surface of the other conductor, the shield effect can be adjusted by adjusting the number or the shape of protrusions.

According to the multilayer shielded wire of (6), since the first and second conductors are electrically connected to each other at the plurality of points by inserting the braided wire having irregularities in the surface thereof or the plurality of thin lines into the insulating layer between the both outer conductors of the inner layer side and the outer layer side, the shield effect can be adjusted by adjusting the shape of the braided wire or the number of thin lines.

According to the present invention, significant electromagnetic shield effect can be obtained compared with the prior art, even in the same number of shield layers and the same interlayer distance.

In the same electromagnetic shield capability as the prior art, the number of layers or the thickness of the layer can be reduced. Accordingly, the metal material used in the shield layer can be reduced, the diameter of the electric wire can be reduced, and lightweight and low cost can be realized.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Hereinafter, embodiments of the present invention will be described in detail with reference to the accompanying drawings.

Figure 1A:
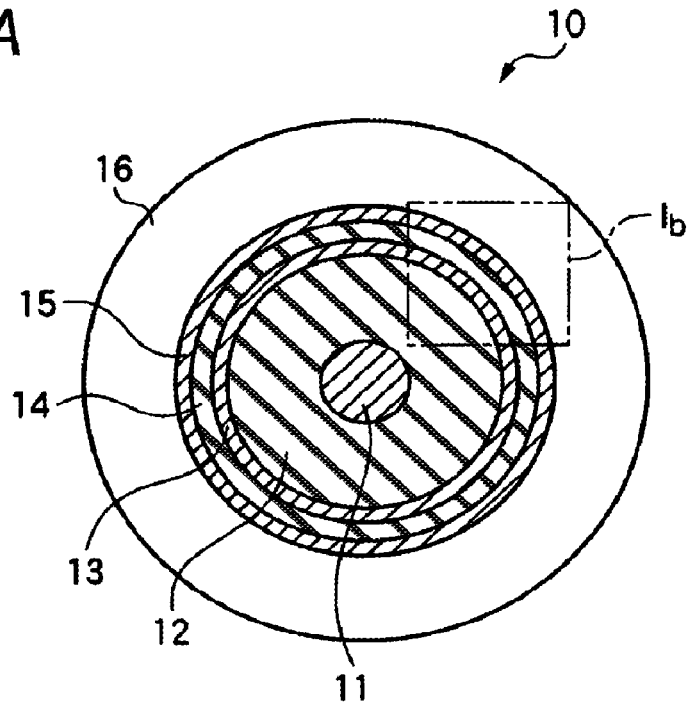
FIG. 1A a cross-sectional view of a shielded wire according to a first embodiment of the present invention and FIG. 1B is an enlarged view of a portion lb of FIG. 1A.
Figure 1B:
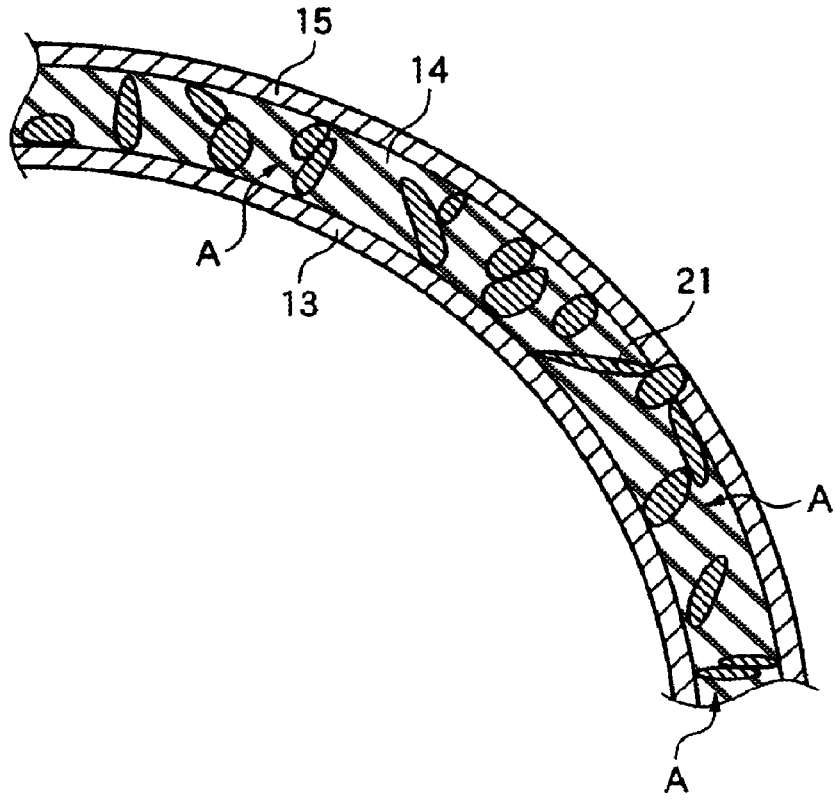
Figure 2:
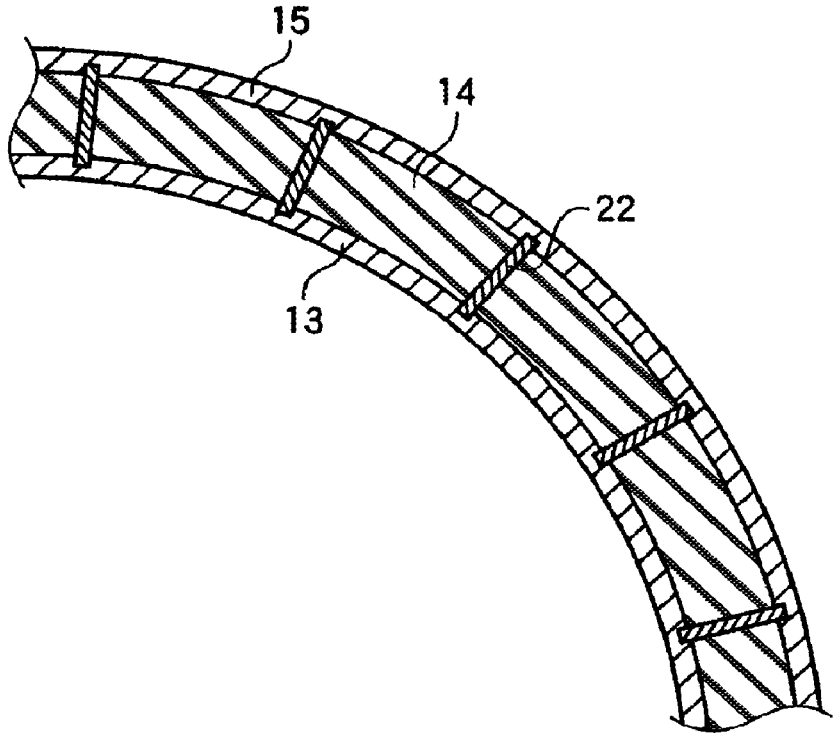
FIG. 2 is a schematic view showing the configuration of main portions of a second embodiment of the present invention.
Figure 3:
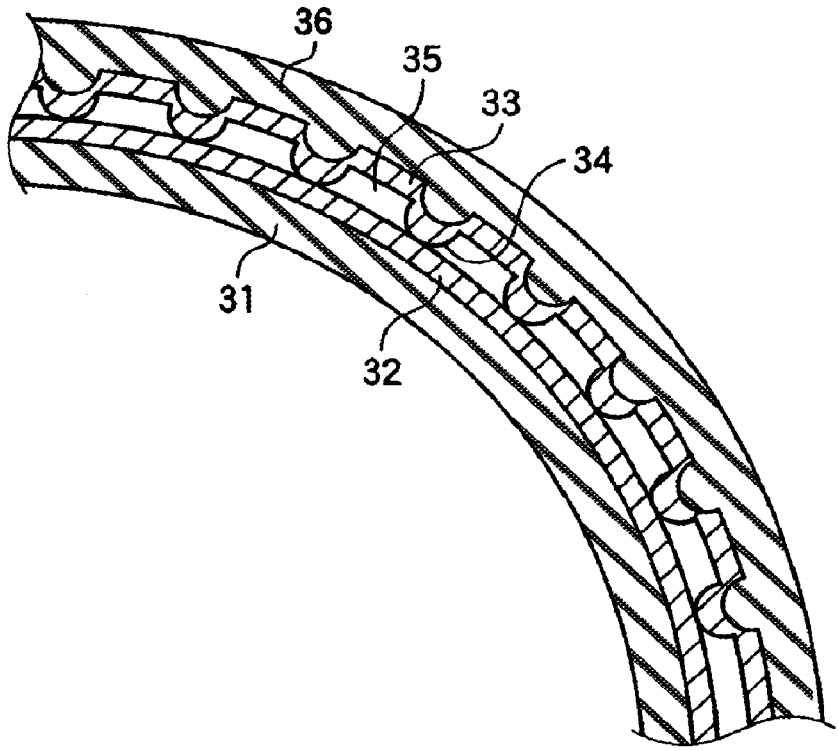
FIG. 3 is a schematic view showing the configuration of main portions of a third embodiment of the present invention.
Figure 4:
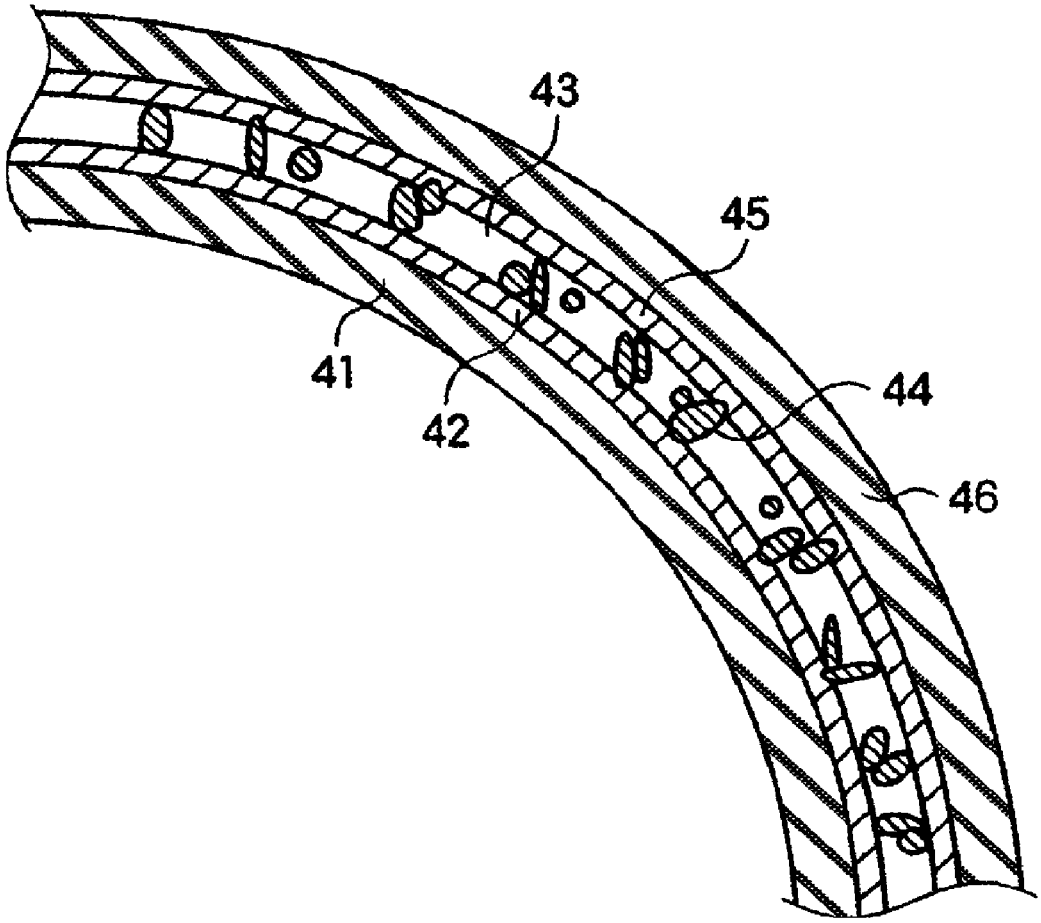
FIG. 4 is a schematic view showing the configuration of main portions of a fifth embodiment of the present invention.
Figure 5:
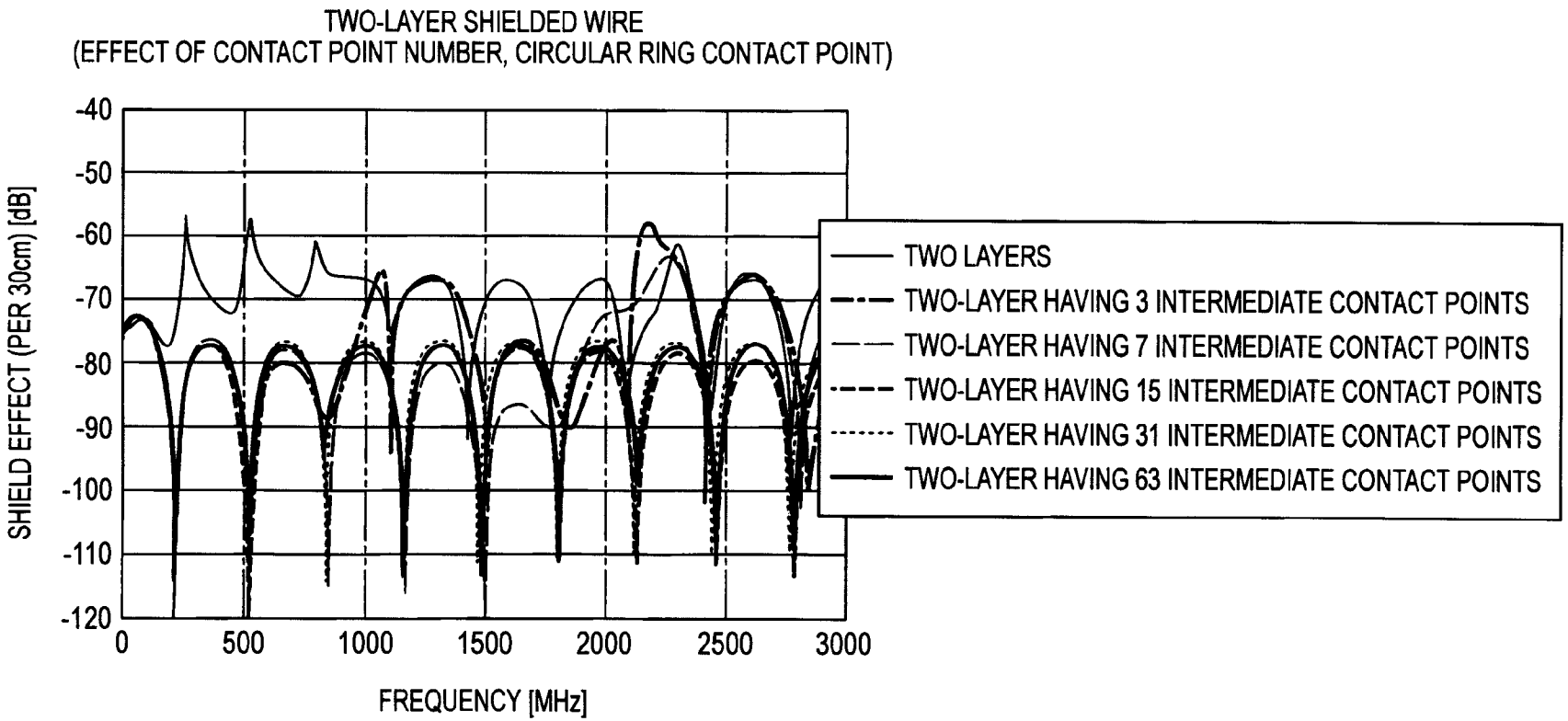
FIG. 5 is a graph showing comparison of shield capabilities of two-layer shielded wires.
Figure 6:
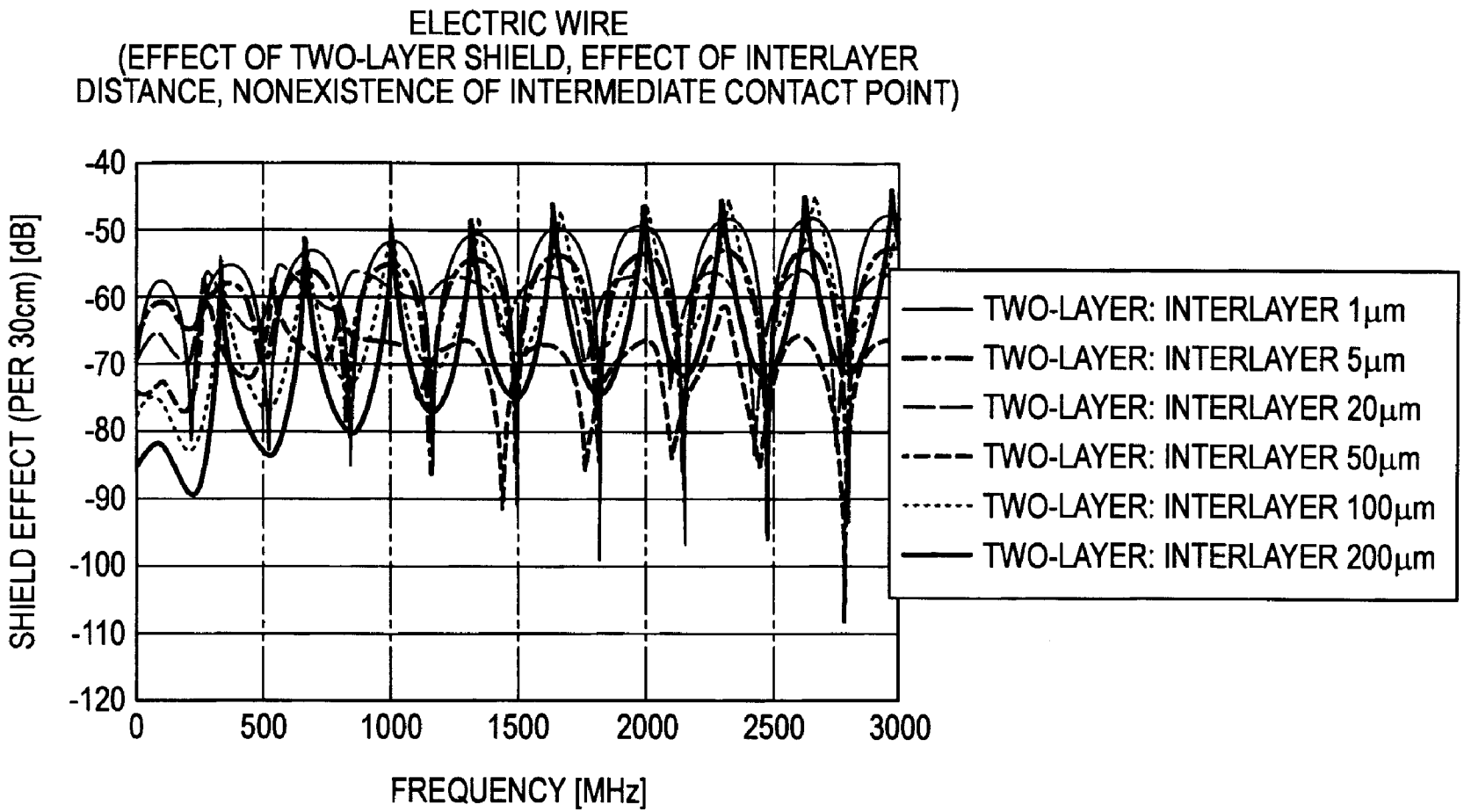
FIG. 6 is a graph showing comparison of shield capabilities of two-layer shielded wires.
Figure 7:
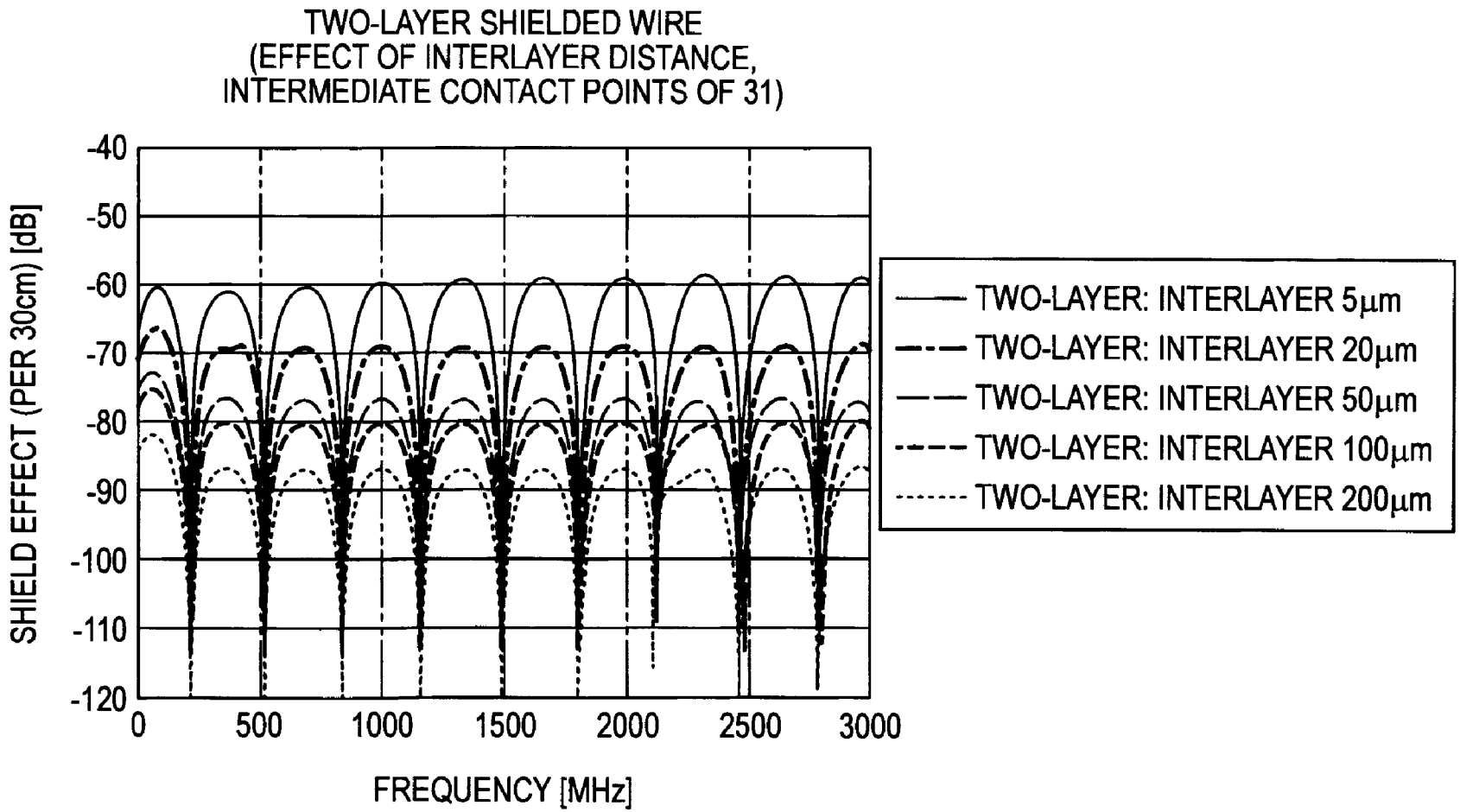
FIG. 7 is a graph showing comparison of shield capabilities of two-layer shielded wires.
Figure 8A:
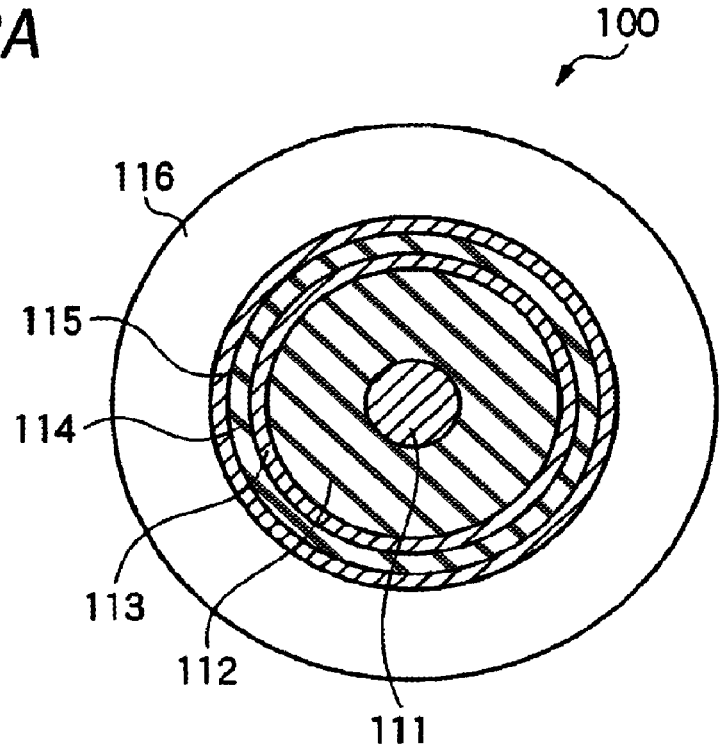
FIG. 8A is a cross-sectional view of a related two-layer shielded wire and FIG. 8B is a perspective view of the related two-layer shielded wire.
Figure 8B:
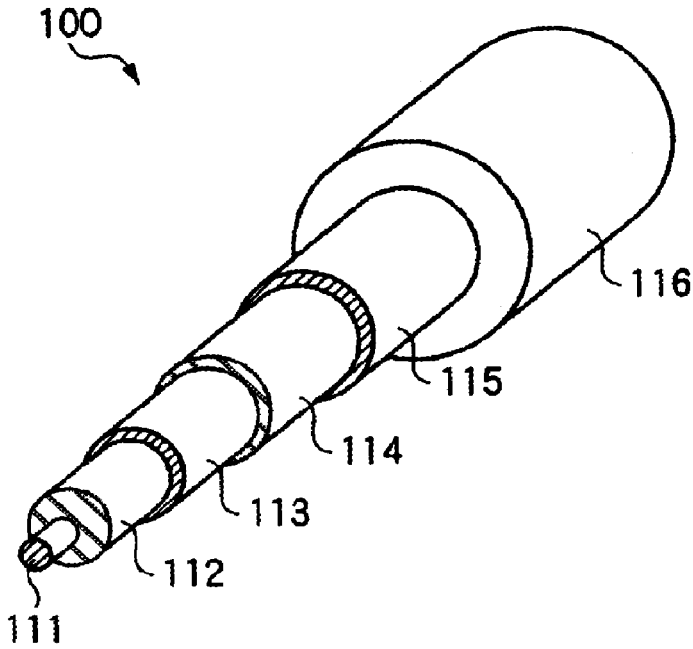
Prior Art FIG. 8B
Figure 9:
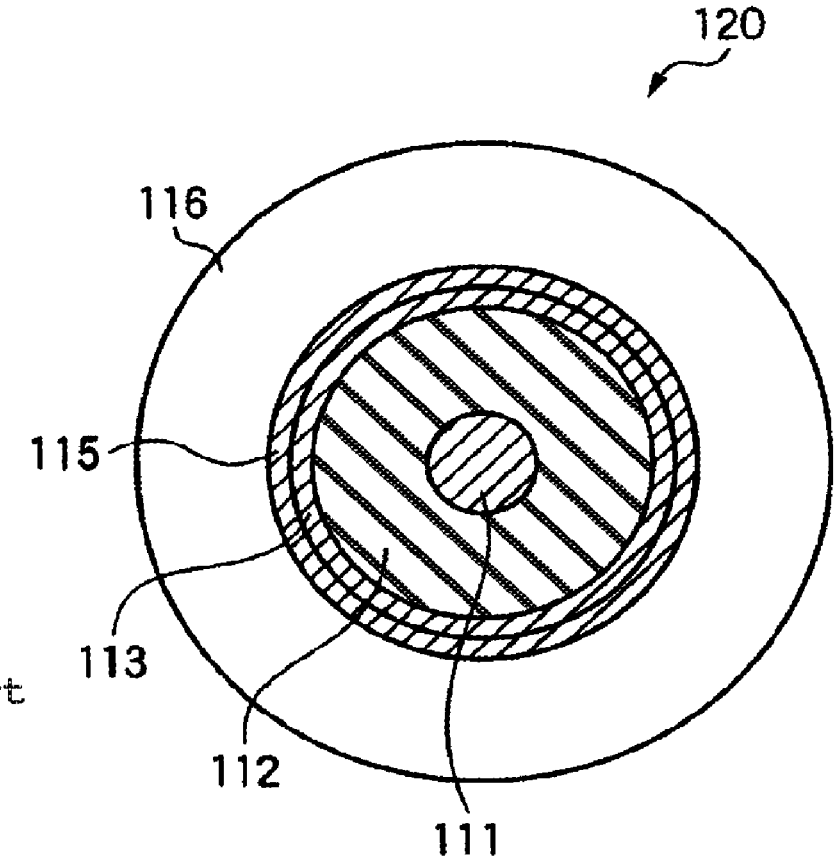
FIG. 9 is a cross-sectional view of another related shielded wire.

FIG. 1 is a view showing the configuration of a first embodiment of the present invention, wherein FIG. 1A is a cross-sectional view of a shielded wire according to the embodiment and FIG. 1B is an enlarged view of a portion lb of FIG. 1A. FIG. 2 is a schematic view showing the configuration of main portions of a second embodiment of the present invention. FIG. 3 is a schematic view showing the configuration of main portions of a third embodiment of the present invention. FIG. 4 is a schematic view showing the configuration of main portions of a fifth embodiment of the present invention. FIGS. 5 to 7 are graphs showing comparison of shield capabilities of two-layer shielded wires.

First Embodiment

The multilayer shielded wire shown in FIG. 1A is a two-layer shielded wire 10 in which an electromagnetic shielded wire is provided by two layers. The circumference of an inner conductor 11 is sequentially covered with two-layer outer conductors 13 and 15 with insulating layers 12 and 14 interposed therebetween and a protective layer 16 is provided on an outermost layer. A predetermined interlayer distance between the outer conductor 13 of an inner layer side and the outer conductor 15 of an outer interlayer side is maintained by an insulating film 14 and the outer conductors 13 and 15 are electrically connected to each other at a plurality of points via a material interposed between the outer conductors 13 and 15.

Next, the structure in which the outer conductors 13 and 15 are in contact with each other at the plurality of points will be described.

In the manufacture of the shielded wire, a film including an electromagnetic shield layer, which is obtained by forming a conductor layer on an insulating film, is generally used when the electric magnetic shield layer is configured. Here, the film including the electromagnetic shield layer is manufactured and is wounded on the outer circumference of the inner conductor 11 and the insulating layer 12 so as to manufacture the shielded wire.

In the first embodiment shown in FIG. 1B, first, conductor layers formed of a metal foil (outer conductors 13 and 15) are provided on the both sides of an insulating film (the insulating layer 14) such as a polyethylene film by lamination or adhesion so as to manufacture the film including the electromagnetic shield layer. At this time, granular or rod-shaped conductors 21 are previously mixed to resin of the insulating film (the insulating layer 14) in a proper distribution such that the conductor layers of the front surface side and the rear surface side are electrically connected to each other at several points of the film. In the example, the conductors 21 are short-circuited at points denoted by a reference numeral A and thus a shield film having the two-layer electromagnetic shield layer which is electrically connected at a plurality of points is obtained.

Accordingly, the shield film is wound on the outer circumference of the insulating layer 12 of FIG. 1A and the protective layer 16 is provided on the outermost layer, thereby manufacturing the two-layer shielded wire 10.

In this case, the shield effect can be adjusted by increasing/decreasing the thickness of the insulating film (the insulating layer 14) so as to adjust the interlayer distance between the conductor layers (outer conductors 13 and 15) or adjusting the amount or the shape of the granular or rod-shaped conductors 21 mixed to the insulating film (the insulating layer 14).

Second Embodiment

In a second embodiment shown in FIG. 2, a plurality of through-holes are provided in the insulating film (the insulating layer 14) formed of polyethylene, a conductive material 22 such as metal rods, metal particles or conductive pigment is filled in the through-holes, and conductor layers formed of a metal foil (corresponding to the outer conductors 13 and 15) are provided on the both surfaces of the insulating film (the insulating layer 14) by lamination or adhesion, thereby manufacturing a film having two-layer electromagnetic shield layer of which the conductor layers on the both surfaces are electrically connected at a plurality of points. The other portions are similar to those of the first embodiment.

In this case, the shield effect can be adjusted by adjusting the thickness of the insulating film and the number of through-holes.

Third Embodiment

In a third embodiment shown in FIG. 3, a plurality of protrusions are provided on the surface of an insulating film 36 formed of polyethylene are provided and a conductor layer 33 such as a metal foil is provided thereon, thereby preparing a first film having the plurality of protrusions 34 on the conductor layer 33. Meanwhile, a conductor layer 32 such as a metal foil is provided on the surface of the insulating film 31 without a protrusion so as to prepare a second film without the protrusion on the conductor layer. Since the first film and the second film overlap each other in a state in which the surfaces of the films on which the conductor layers 32 and 33 are provided face each other such that a gap 35 is ensured by the existence of the protrusions 34, a film having a two-layer electromagnetic shield layer in which the conductor layers 32 and 33 are electrically connected to each other at a plurality of points is obtained. The other portions are similar to those of the first embodiment.

In this case, the shield effect can be adjusted by adjusting the number of protrusions (distribution density) or the size of the protrusions. In particular, an interlayer distance can be changed by adjusting the height of the protrusions.

Fourth Embodiment

Although not shown, in a fourth embodiment, irregularities are alternately formed in the insulating film formed of polyethylene and a conductor layer such as a metal foil is formed thereon, thereby preparing a first film. A conductor layer such as a metal foil is provided on the surface of an insulating film without irregularities so as to prepare a second film. The first film and the second film overlap each other in a state in which the surfaces of the films on which the conductor layers are provided face each other, such that a film having a two-layer electromagnetic shield layer in which the conductor layers are electrically connected to each other at a plurality of points is obtained. The other portions are similar to those of the first embodiment.

In this case, the shield effect can be adjusted by adjusting the number of irregularities (distribution density) or the size of the irregularities. In particular, an interlayer distance can be changed by adjusting the height of the protrusions.

Fifth Embodiment

In a fifth embodiment shown in FIG. 4, two films which are formed by providing conductor layers 42 and 45 such as metal foils on one surfaces of insulating films 41 and 46 formed of polyethylene are adhered via a conductive adhesive 43 including granular or rod-shaped conductors 44 in a state in which the conductor layers 42 and 45 face each other, thereby obtaining a film having a two-layer electromagnetic shield layer in which the two conductor layers 42 and 45 are electrically connected to each other at a plurality of points. The other portions are similar to those of the first embodiment.

In this case, the shield effect can be adjusted by adjusting the thickness of the conductive adhesive 43 or the amount or the shape of the conductors 44 mixed thereto.

Six Embodiment

Although not shown, in a six embodiment, two insulating films, in which conductor layers such as metal foils are provided on one surfaces thereof, are adhered with a braided wire or a plurality of thin lines interposed therebetween in a state in which the conductor layers face each other, thereby obtaining a film having a two-layer electromagnetic shield layer in which the two conductor layers are electrically connected to each other at a plurality of points. The other portions are similar to those of the first embodiment.

In this case, since the braided wire has irregularities in the surface thereof, a point contact state is formed. By the diameter of the thin lines of the braided wire, the spatial height between the conductor layer and the braided wire formed of the metal foil is changed. The contact density is changed by the density of the braided wire.

Accordingly, the shield effect can be adjusted by adjusting these parameters.

In addition, the density of the braided wire used therein may be set to be lower than that in the case of being used as the shield layer. Instead of the braided wire, thin lines may be arranged at intervals.

In this case, the contact has a linear shape, but the same effect as the braided wire can be obtained.

A resin material other than polyethylene may be used in the insulating films 14, 31, 36, 41 and 46. Aluminum or copper may be properly used as metal configuring the conductor layers 13, 15, 32, 33, 42 and 45, but other metal materials having an excellent electric property may be used.

Although the electromagnetic shield layer (outer conductor or conductor layer) is formed by two layers in the embodiments, the electromagnetic shield layer may be provided by three layers or more. In this case, the same effect can be obtained.

The braided wire may be used instead of the metal foil. When the braided wires are directly brought into contact with each other, the multipoint conduction is realized by the irregularities of the surface. However, since the braided wire has a plurality of small openings, it may not be proper in a high frequency. Since the braided wire has a structural thickness compared with a foil, the weight is increased and thus the outer diameter of the electric wire is increased.

Embodiment

Next, the simulation result of a two-layer shielded wire in which a shield layer (conductive layer) of 20 μm is formed by two layers and the interlayer distance (polyethylene thickness) is 50 μm using an operator with respect to the shield effect using the contact state between the two layers as a parameter (variable) will be described.

FIGS. 5 to 7 show the simulation result.

This simulation was performed by virtually reproducing a surface transfer impedance meter in MIL-C-85485 standard and decreasing the length of a line to 30 cm instead of 1 m in consideration of the capability of the operator. Since the simulation result can be obtained by an S parameter (an input/output power ratio), it was described as the shield effect (unit: dB) of the power ratio, instead of the surface transfer impedance value (30 cm). A vertical axis of the graph denotes a minus dB and the shield effect is increased as the value is decreased.

From the graph shown in FIG. 5, if the number of contact points in the line length of 30 cm is zero, three, seven, 15, 31 or 63, in a frequency band of 0 to 2 GHz, there is no difference in 200 MHz or less and the shield effect is improved as the number of contact points is increased to three or seven. If the number of contact points is 15 or more, a change is small, but the effect of about 10 dB is obtained compared with the case that the contact point does not exist.

If the number of contacts in the length of 30 cm is 15 or more, in the density of an interval of 2 cm or more, sufficient effect can be obtained. This simulation result is computed when the contact exists in a circular ring, but the same result can be obtained even when the number of contact points is 1 or 4 (interval of 90 degrees) on a circumference.

FIG. 6 shows the change in shield effect when the interlayer distance is increased/decreased by 50 μm a case where the contact point does not exist and FIG. 7 shows the change in shield effect when the interlayer distance is increased/decreased by 50 (m a case where the number of contact points is 31.

As shown in FIG. 6, if the contact point does not exist, the effect is not obtained although the distance is increased/decreased by 50 (m. In contrast, if the number of contact points is 31, as shown in FIG. 7, the shield effect appears as the interlayer distance is increased.

In the nonexistence of the contact point and the interlayer distance of 50 (m of FIG. 5 and the number of contact points of 31 and the interlayer distance of 200 (m of FIG. 7, an effect difference of about 20 dB occurs.

From the above-described result, it is preferable that the number of contacts between block layers is large. In this case, the shield effect is increased according to the interlayer distance. That is, according to the present invention, significant shield effect can be obtained compared with the prior art, even in the same number of shield layers and the same interlayer distance.

If the interlayer distance is zero and the layers are completely in contact with each other in the whole surface, only the effect of one layer having a thickness can be obtained.

If a copper foil having a thickness of 20 (m is formed by two layers, in the nonexistence of the contact point and the interlayer distance of 50 (m of FIG. 6, in which the contact point does not exist at the interlayer distance (polyethylene layer) of 50 (m, and the number of contact points of 31 and the interlayer distance of 20 (m of FIG. 7, in which the layers contact each other at the plurality of points at an interlayer distance of 20 (m, it can be seen that the same effect can be obtained.

That is, according to the present invention, in the case of realizing high capability and the same capability as the prior art, for example, since the layer between the two layers can thin to 30 (m like this comparative example, the outer diameter can be reduced. Accordingly, the metal material used in the shield layer can be reduced, the diameter of the electric wire can be reduced, and lightweight and low cost can be realized.

The present invention is not limited to the above-described embodiments and may be properly modified or changed. The materials, the shapes, the dimensions, the number, and the positions of the components in the above-described embodiments are not limited if the present invention can be realized.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2007-161340 filed on Jun. 19, 2007, the contents of which are incorporated herein for reference.

What is claimed is:

1. A multilayer shielded wire, comprising:

an inner conductor;

a first conductor which covers the inner conductor through a first insulating layer; and a second conductor which covers the first conductor through a second insulating layer;

wherein a predetermined interlayer distance between the first conductor and the second conductor are set; and wherein a conductive portion is provided between the first conductor and the second conductor to electrically connect the first conductor to the second conductor at a plurality of points.

2. The multilayer shielded wire according to claim 1, wherein the conductive portion is formed by granular or rod-shaped conductors which are contained in a resin material configuring the second insulating layer.

3. The multilayer shielded wire according to claim 1, wherein the conductive portion is formed by granular or rod-shaped conductors which are filled in through-holes in a resin film configuring the second insulating layer.

4. The multilayer shielded wire according to claim 1, wherein the conductive portion includes a plurality of protrusions which are formed on a surface of at least one of the first and second conductors; and wherein the protrusions are brought into contact with a surface of the other of the first and second conductors so that the first and second conductors are electrically connected to each other at the plurality of points.

5. The multilayer shielded wire according to claim 1, wherein at least one of the first and second conductors has a wave shape in which concavities and convexities are alternately arranged; and wherein tops of the convexities are brought into contact with a surface of the other of the first and second conductors so that the first and second conductors are electrically connected to each other at the plurality of points.

6. The multilayer shielded wire according to claim 1, wherein the conductive portion includes a braided wire having concavities and convexities in a surface thereof or a plurality of thin lines.

7. The multilayer shielded wire according to claim 1, wherein the first and second conductors are metallic conductors.

8. The multilayer shielded wire according to claim 1, wherein the first and second conductors are constructed of metal foil.

9. The multilayer shielded wire according to claim 1, wherein the predetermined interlayer distance between the first conductor and the second conductors is constant, and a material of the conductive portion is independent of materials of the first and the second conductors.

* * * * *